US006802668B2

(12) United States Patent
Parker

(10) Patent No.: US 6,802,668 B2
(45) Date of Patent: Oct. 12, 2004

(54) SUBTERRANEAN DRAINAGE SYSTEM

(76) Inventor: Alton F. Parker, 16 Tracey Ct., Clifton Park, NY (US) 12065

( * ) Notice: Subject to any disclaimer, the term of this patent is extended or adjusted under 35 U.S.C. 154(b) by 0 days.

(21) Appl. No.: 10/272,971

(22) Filed: Oct. 16, 2002

(65) Prior Publication Data

US 2004/0076474 A1 Apr. 22, 2004

(51) Int. Cl.[7] ..... E02B 11/00; E02D 19/00; E02D 31/02

(52) U.S. Cl. ..... 405/49; 52/408

(58) Field of Search ..... 405/36, 43, 45, 405/49; 52/169.4, 169.5, 408

(56) References Cited

U.S. PATENT DOCUMENTS 4,572,700 A * 2/1986 Mantarro et al. ..... 404/35
4,574,541 A * 3/1986 Raidt et al. ..... 52/169.5
4,840,515 A * 6/1989 Freese ..... 405/45
4,943,185 A * 7/1990 McGuckin et al. ..... 405/45
4,956,951 A * 9/1990 Kannankeril ..... 52/169.5
5,052,161 A * 10/1991 Whitacre ..... 52/385
5,263,792 A * 11/1993 Davis et al. ..... 405/45
5,383,314 A * 1/1995 Rothberg ..... 52/169.5
5,489,462 A * 2/1996 Sieber ..... 428/174
5,692,348 A * 12/1997 Ambrosino ..... 52/169.5
5,775,039 A * 7/1998 McPherson ..... 52/169.5
5,820,296 A * 10/1998 Goughnour ..... 405/43
6,048,131 A * 4/2000 Laak ..... 405/43
6,280,117 B1 * 8/2001 Obermeyer et al. ..... 405/119
2003/0082005 A1 * 5/2003 Scott ..... 405/43
2003/0126810 A1 * 7/2003 Brunson et al. ..... 52/169.5

OTHER PUBLICATIONS

DrainStar Stripdrain—http://www.drainstar.com/images/gallery/MVC–018F.jpg—6 pages.
AMERDRAIN 200—http://www.americanwick.com/amer200spec.html—4 pages.

* cited by examiner

*Primary Examiner*—Robert E. Pezzuto
*Assistant Examiner*—Tara L. Mayo
(74) *Attorney, Agent, or Firm*—Schmeiser, Olsen & Watts

(57) ABSTRACT

A subterranean drain system that includes hollow dimples that extend perpendicularly from a drain board. The system also includes a connector that typically allows multiple boards to be connected together, or to connect to other elements.

11 Claims, 8 Drawing Sheets

SUBTERRANEAN DRAINAGE SYSTEM

FIELD OF THE INVENTION

The present invention relates to the field of drainage systems; more specifically, it relates to a subterranean drainage system for structures, which are buried wholly or partially beneath the surface of the earth.

BACKGROUND OF THE INVENTION

Proper drainage is an important consideration in the design and construction of subterranean structures that may be partially or completely buried. Such subterranean structures include walls and footings that may be formed from poured concrete, cement blocks or other materials. Without proper drainage, hydrostatic pressure can result in structural damage and leakage into the interior of the structure.

Conventional drainage systems have used perforated pipe laid in a gravel bed along a side of the structure. However, because the pipe-in-gravel system still allows water to contact the structure above the gravel bed, this system is not always successful in protecting the structure. A development in this area is dimpled drain boards comprising a series of raised dimples that provide structural integrity to the board while allowing water to flow between the dimples when the board is laid vertically or horizontally. Because the board may be wide, more of the structure may be covered. To prevent earth and other materials from clogging the space between the hollow dimples, a water permeable mat is placed over the dimples.

However, several problems exist with current dimple board drainage systems. For example, the volume of water that may be drained is fixed and limited by the geometry of the hollow dimple board, and in large area installations, water may back up as the bottom of the drainage system fills. Further, assembly of boards and attachment of outlets can require the use of large numbers of fasteners increasing the time and labor required for installation of the system, especially in large and complex structures.

Therefore, there is a need for a drainage system that is field adjustable in terms of the quantity of water it can handle and that minimizes the need for fasteners.

SUMMARY OF THE INVENTION

A first aspect of the present invention is a dimpled drain board comprising: a planar base; a hollow dimple extending perpendicularly from the planar base; and a connector, the connector adapted to maintain the planar base in a spaced apart relationship from another planar base of another dimpled drain board having another hollow dimple.

A second aspect of the present invention is a dimpled drain board comprising:

a planar base having a first surface and a second surface;

a multiplicity of hollow dimples arranged in a repeating pattern and extending perpendicularly from said planar base, each hollow dimple having a sidewall, a closed top and a bottom open to said second surface; and a connector operatively associated with all or less than all said hollow dimples, each connector adapted to maintain said planar base and another planar base of another dimpled drain board in a spaced apart relationship.

A third aspect of the present invention is a drainage system comprising: at least two dimpled drain boards, each dimpled drain board including: a planar base having a first surface and second surface; a multiplicity of hollow dimples arranged in a repeating pattern and extending perpendicularly from said first surface of said base, each hollow dimple having a sidewall, a closed top and a bottom open to said second surface; and a connector on all or less than all said hollow dimples, each connector adapted to maintain said planar base of said dimpled drain board and another planar base of another dimpled drain board in a spaced apart relationship, said another dimpled drain board having other hollow dimples identical to said hollow dimples of said dimpled drain board; and filter means arranged to prevent non-fluid materials from depositing between said hollow dimples.

A fourth aspect of the present invention is a drainage system comprising: a dimpled drain board comprising a planar base having a first surface and second surface and a multiplicity of hollow dimples arranged in a repeating pattern extending perpendicularly from said first surface of said base, each hollow dimple having a sidewall, a closed top and a bottom open to said second surface; and a connector operatively engaged to one or more of said hollow dimples of said dimpled drain board.

BRIEF DESCRIPTION OF DRAWINGS

The features of the invention are set forth in the appended claims. The invention itself, however, will be best understood by reference to the following detailed description of an illustrative embodiment when read in conjunction with the accompanying drawings, wherein:

DETAILED DESCRIPTION OF THE INVENTION

For the purposes of the present invention, it should be understood that elements designated with a reference number including an appended alpha character (e.g., A, B, C etc.) represent multiple copies of an element having the same reference number without the appended alpha character and are identical to that element.

Figure 1:
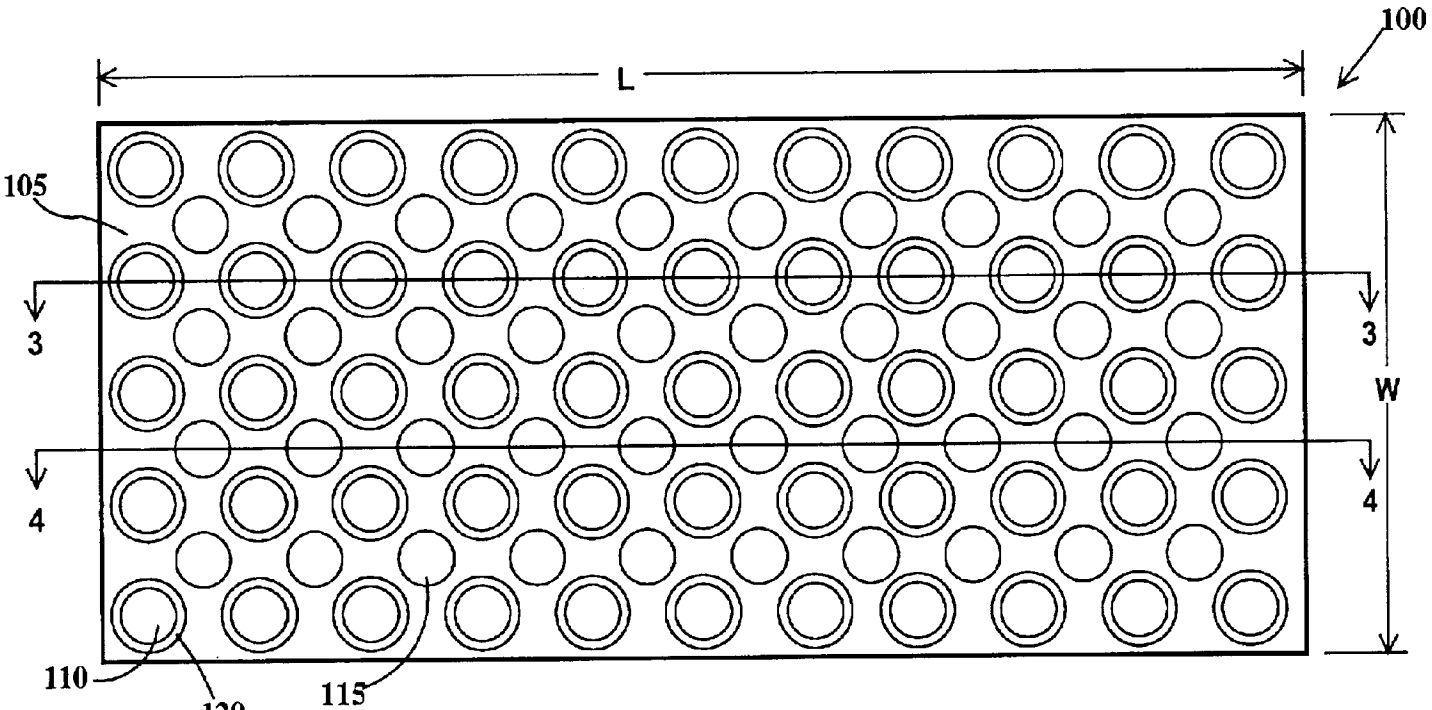
FIG. 1 is a top view of a dimpled drain board according to a first embodiment of the present invention.

FIG. 1 is a top view of a dimpled drain board 100 according to a first embodiment of the present invention. In FIG. 1, dimpled drain board 100 include a planar base 105 containing a multiplicity of projecting hollow dimples 110 projecting perpendicularly from base 105. A multiplicity of optional through holes 115, formed in base 105, are interspersed with hollow dimples 110. Each hollow dimple 115 includes a projecting lip 120. A feature of dimpled drain board 100 is that hollow dimples 110 are formed on base portion 105 in a regular, repeating and uniform pattern. Dimpled drain board 100 has a length "L" and a width "W." In one example, "L" is between about 8 feet and 500 feet and "W" is between about 6 inches and 48 inches. However, dimpled drain board may be any length or any width. Suitable materials for dimpled drain board 100 include, for example, semi-rigid plastics such as polystyrene, polyethylene, poly-vinyl-chloride, polyethylene terephthalate and acrylonitrile-butadiene-styrene copolymer.

Figure 2:
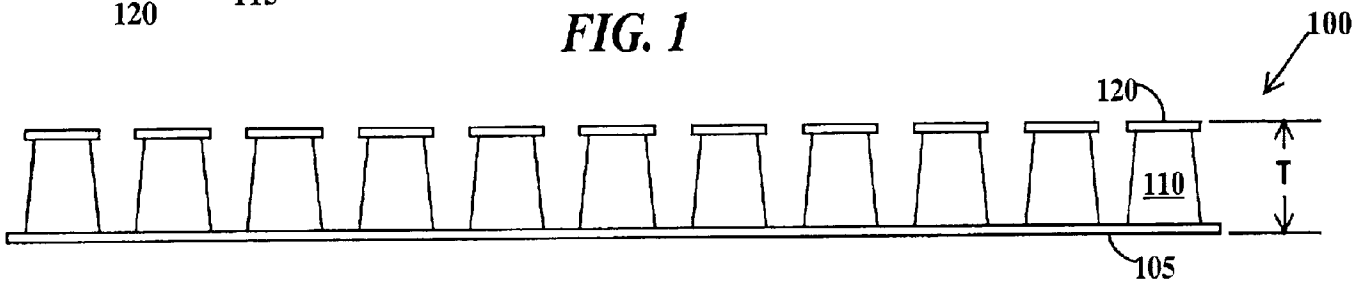
FIG. 2 is a side view of the dimpled drain board of FIG. 1.

FIG. 2 is a side view of the dimpled drain board 100 of FIG. 1. In FIG. 2, dimpled drain board 100 has a thickness "T." In one example, "T" is between about one-quarter inch and one-inch. However, any suitable value for "T" may be selected depending upon the precise application for which dimpled drain board 100 is to be used. In the present example, hollow dimple 110 has the shape of a truncated cone, the widest portion of the cone in proximity to base 105 of dimpled drain board 100.

Figure 3:
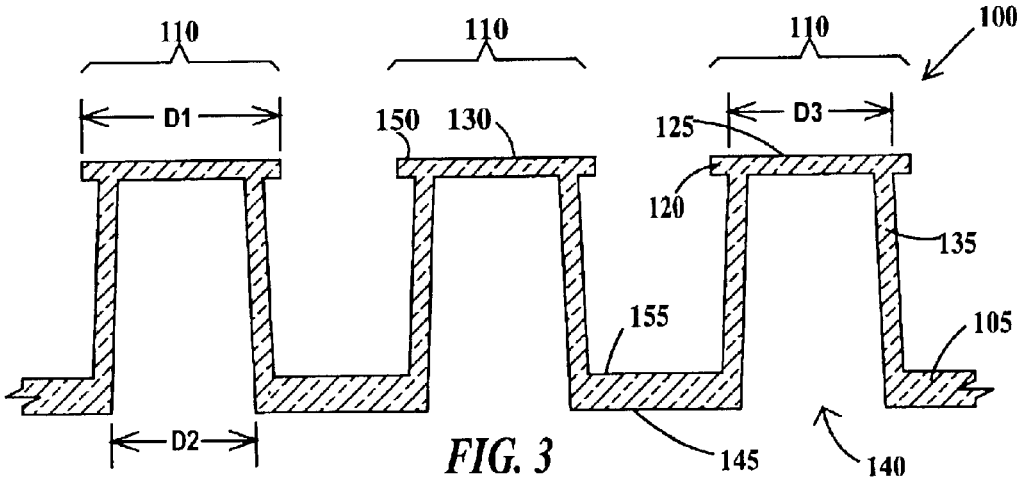
FIG. 3 is a partial cross-sectional view through line 3—3 of FIG. 1.

FIG. 3 is a partial cross-sectional view through line 3—3 of FIG. 1. In FIG. 3, each hollow dimple 110 includes a closed top 125 having a top surface 130 and a sidewall 135. Hollow dimple 110 is closed at the top and has an opening 140 open to base 105 at a bottom surface 145 of base 105. A top surface 150 of projecting lip 120 is coplanar with top surface 130 of top 125. The width "D1" of top 125 and projecting lip 120 together must be greater than the width "D2" of opening 140 in base 105. This is more fully discussed infra in reference to FIG. 5B. Sidewall 135 slope inward so hollow dimple 110 is narrower at top surface 130 than at base 105. The width "D3" of top surface 130 may be equal to or less than the width "D2."

Figure 4:
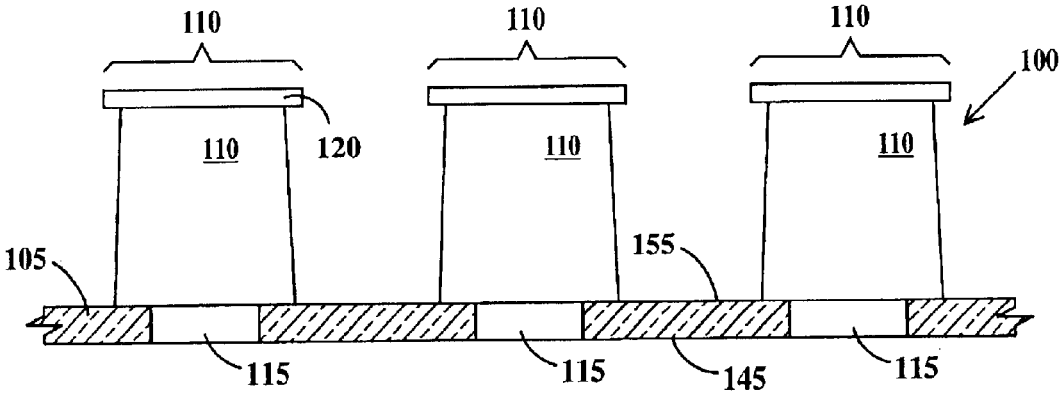
FIG. 4 is a partial cross-sectional view through line 4—4 of FIG. 1.

FIG. 4 is a partial cross-sectional view through line 4—4 of FIG. 1. In FIG. 4, optional through holes 115 extend from a top surface 155 to bottom surface 145 of base 105.

Figure 5A:
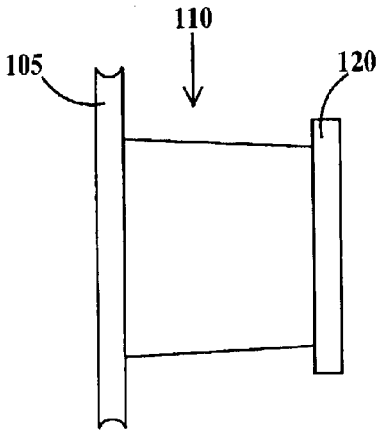
FIG. 5A is a side view of a hollow dimple according to the first embodiment of the present invention.
Figure 5B:
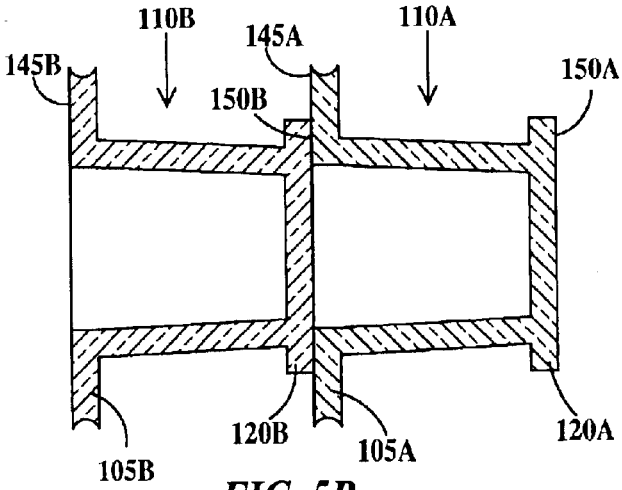
FIG. 5B is a partial cross-sectional view illustrating the engagement of hollow dimples from two different dimpled drain boards according to the first embodiment of the present invention.

FIG. 5A is a side view of a hollow dimple 110 and FIG. 5B is a partial cross-sectional view illustrating the engagement of hollow dimples from two different dimpled drain boards according to the first embodiment of the present invention. In FIG. 5B, a first hollow dimple 110A is prevented from slipping over a second hollow dimple 110B by lip 120B on second hollow dimple 110B. This keeps a first base 105B (and first hollow dimple 110A) spaced apart from a second base 105A (and second hollow dimple 110B). Otherwise, a bottom surface 145A of first base 105A may collapse toward a top surface 155B of second base 105B. First and second hollow dimples 110A and 110B represent a multiplicity of hollow dimples 110A and 110B on respective dimpled drain boards 100A and 110B (not shown) and thus the respective dimpled drain boards are held in a spaced apart relationship.

In FIGS. 1 through 5A hollow dimples 110 and in FIG. 5B, hollow dimples 110A and 110B are illustrated as having the shape of a truncated cone. Hollow dimples 110, 110A and 110B may also be formed in other shapes. For example, hollow dimples 110, 110A and 110B may be formed in the shape of a multi-sided truncated pyramid, a cylinder with one closed end or a multi-sided box with one closed end or a semi-sphere with a flattened surface. These alternative shapes are applicable to all embodiments of the present invention as well, however truncated cones or closed end cylinders will be used to illustrate the further embodiments.

Figure 6A:
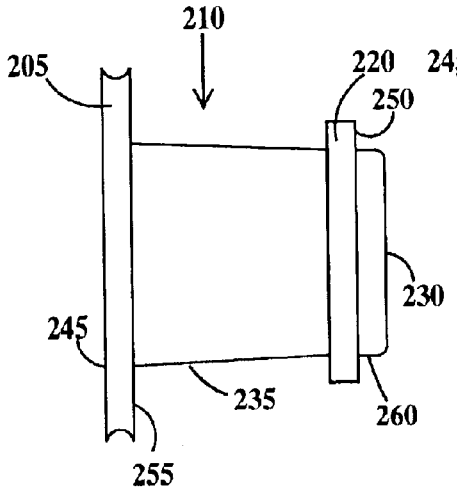
FIG. 6A is a side view of a hollow dimple according to a second embodiment of the present invention.
Figure 6B:
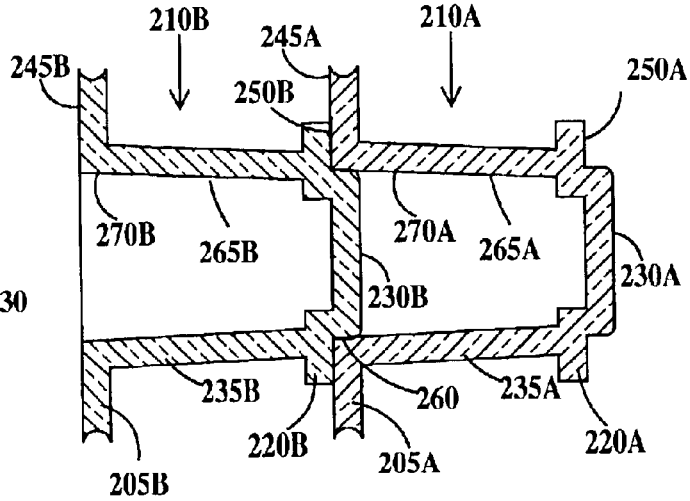
FIG. 6B is a partial cross-sectional view illustrating the engagement of hollow dimples from two different dimpled drain boards according to the second embodiment of the present invention.

FIG. 6A is a side view of a hollow dimple 210 and FIG. 6B is a partial cross-sectional view illustrating the engagement of hollow dimples from two different dimpled drain boards according to the second embodiment of the present invention. In FIG. 6A, hollow dimple 210 is similar to hollow dimple 110 (see FIG. 5A) and is attached to a base 205. Hollow dimple 210 includes a lip 220, a sidewall 235 and a top surface 230. Base 215 has a bottom surface 245 and a top surface 255. Lip 220 has a top surface 250. Hollow dimple 210 differs from hollow dimple 110 (see FIG. 5A) in top surface 250 of lip 220 is not co-planar with top surface 230 of hollow dimple 210, but set back from top surface 230, exposing an edge 260 of sidewall 235.

In FIG. 6B, a first hollow dimple 210A is prevented from slipping over a second hollow dimple 210B by lip 220B on second hollow dimple 210B. This keeps a first base 205B spaced apart from a second base 205A. Otherwise, a bottom surface 245A of first base 205A may collapse toward a top surface 255B of second base 205B. Further, a bottom portion 270A of an interior surface 265A of hollow dimple 210A tightly fits (i.e., frictionally engages) an edge 260B of second hollow dimple 210B. First and second hollow dimples 210A and 210B represent a multiplicity of hollow dimples 210A and 210B on respective dimpled drain boards 200A and 210B (not shown) and thus the respective dimpled drain boards are held in a spaced apart relationship.

Figure 7A:
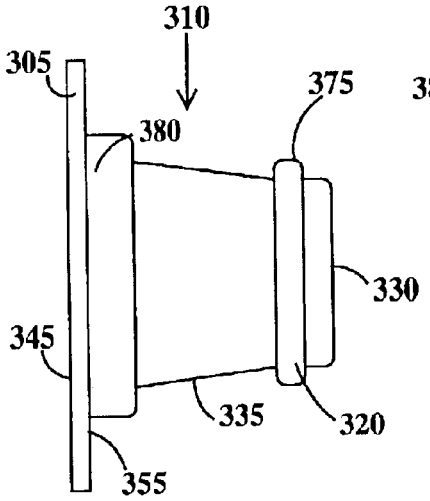
FIG. 7A is a side view of a hollow dimple according to a third embodiment of the present invention.
Figure 7B:
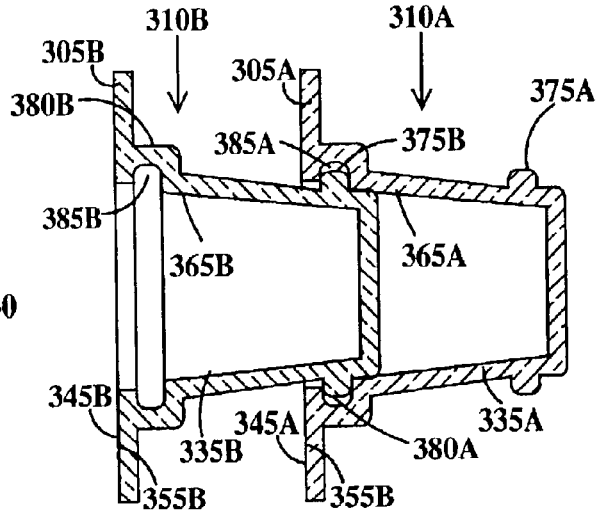
FIG. 7B is a partial cross-sectional view illustrating the engagement of hollow dimples from two different dimpled drain boards according to the third embodiment of the present invention.

FIG. 7A is a side view of a hollow dimple 310 and FIG. 7B is a partial cross-sectional view illustrating the engagement of hollow dimples from two different dimpled drain boards according to the third embodiment of the present invention. In FIG. 7A, hollow dimple 310 is similar to hollow dimple 110 (see FIG. 5A) and is attached to a base 305. Hollow dimple 310 includes a lip 320, a sidewall 335 and a top surface 330. Base 315 has a bottom surface 345 and a top surface 355. Lip 320 has an edge 375. Lip 320 is set back from top surface 330. Hollow dimple 310 includes a flange 380 adjacent to bottom surface 345 of base 305.

In FIG. 7B, a first hollow dimple 310A snaps onto a second hollow dimple 310B. A recess 385A formed inside of flange 380A engages an edge 375B of lip 320B of second hollow dimple 310B. This keeps a first base 305B spaced apart from a second base 305A. First and second hollow dimples 310A and 310B represent a multiplicity of hollow dimples 310A and 310B on respective dimpled drain boards 300A and 300B (not shown) and thus the respective dimpled drain boards are held in a spaced apart relationship.

Figure 8A:
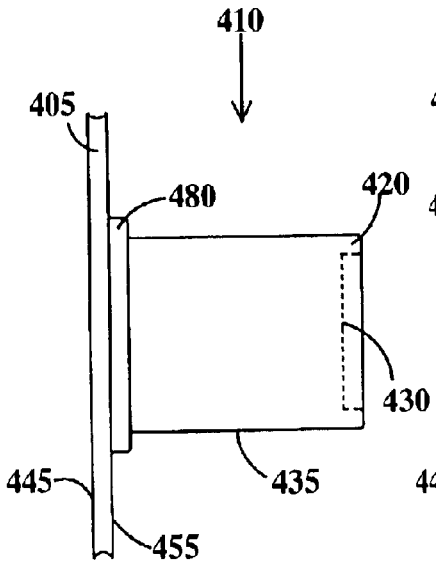
FIG. 8A is a side view of a hollow dimple according to a fourth embodiment of the present invention.
Figure 8B:
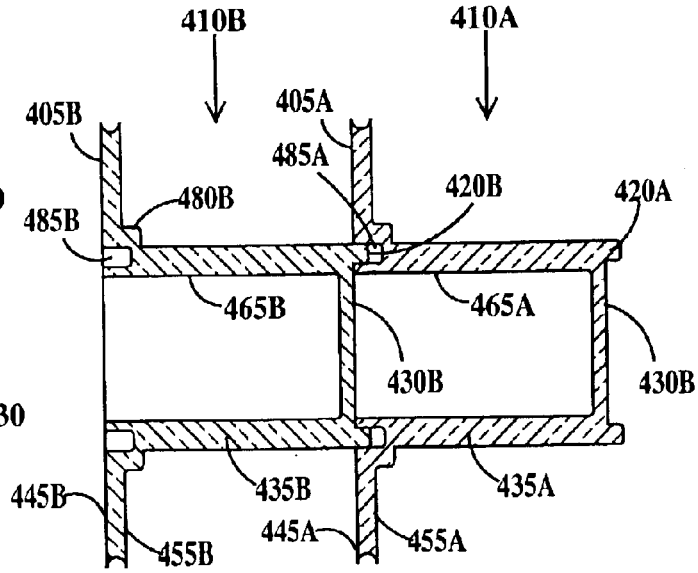
FIG. 8B is a partial cross-sectional view illustrating the engagement of hollow dimples from two different dimpled drain boards according to the fourth embodiment of the present invention.

FIG. 8A is a side view of a hollow dimple 410 and FIG. 8B is a partial cross-sectional view illustrating the engagement of hollow dimples from two different dimpled drain boards according to the fourth embodiment of the present invention. In FIG. 8A, hollow dimple 410 is similar to hollow dimple 110 (see FIG. 5A) and is attached to a base 405. Hollow dimple 410 includes a lip 420, a sidewall 435 and a top surface 430. Base 415 has a bottom surface 445 and a top surface 455. Lip 420 extends perpendicular to top surface 430. Hollow dimple 410 includes a flange 480 adjacent to bottom surface 445 of base 405.

In FIG. 8B, a first hollow dimple 410A snaps onto a second hollow dimple 410B. A recess 485A formed inside of flange 480A engages lip 420B of second hollow dimple 410B. A portion of bottom surface 445A adjacent to an interior surface 465A of first hollow dimple 410A rests on top surface 430B of second hollow dimple 410B. This keeps a first base 405B spaced apart from a second base 405A. First and second hollow dimples 410A and 410B represent a multiplicity of hollow dimples 410A and 410B on respective dimpled drain boards 400A and 400B (not shown) and thus the respective dimpled drain boards are held in a spaced apart relationship.

Figure 9A:
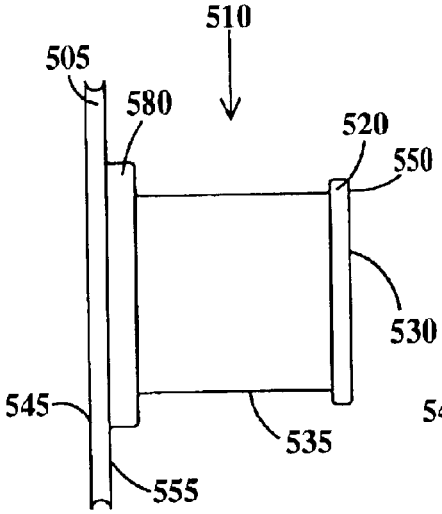
FIG. 9A is a side view of a hollow dimple according to a fifth embodiment of the present invention.
Figure 9B:
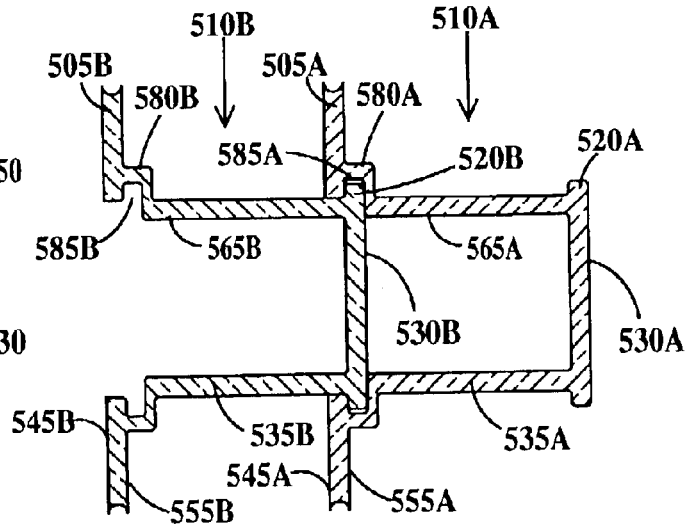
FIG. 9B is a partial cross-sectional view illustrating the engagement of hollow dimples from two different dimpled drain boards according to the fifth embodiment of the present invention.

FIG. 9A is a side view of a hollow dimple 510 and FIG. 9B is a partial cross-sectional view illustrating the engagement of hollow dimples from two different dimpled drain boards according to the fifth embodiment of the present invention. In FIG. 9A, hollow dimple 510 is similar to hollow dimple 410 (see FIG. 8A) and is attached to a base 505. Hollow dimple 510 includes a lip 520, a sidewall 535 and a top surface 530. Base 515 has a bottom surface 545 and a top surface 555. Lip 520 extends perpendicular to sidewall 535 and a top surface 550 of lip 520 is co-planar with top surface 530. Hollow dimple 510 includes a flange 580 adjacent to bottom surface 545 of base 505.

In FIG. 9B, a first hollow dimple 510A snaps onto a second hollow dimple 510B. A recess 585A formed inside of flange 580A engages lip 520B of second hollow dimple 510B. A portion of a sidewall 565A adjacent to recess 585A of first hollow dimple 510A rests on top surface 530B of second hollow dimple 510B. This keeps a first base 505B spaced apart from a second base 505A. First and second hollow dimples 510A and 510B represent a multiplicity of hollow dimples 510A and 510B on respective dimpled drain boards 500A and 510B (not shown) and thus the respective dimpled drain boards are held in a spaced apart relationship.

Figure 10A:
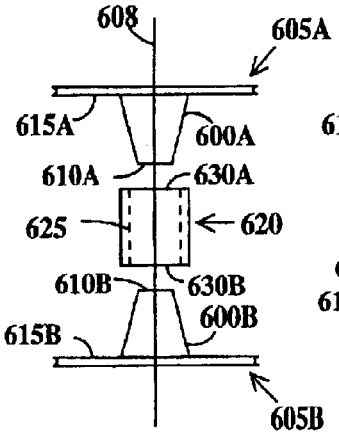
FIG. 10A is an exploded side view of a first connector for jointing two conventional dimple boards according to a sixth embodiment of the present invention.

FIG. 10A is an exploded side view of a first connector for jointing two conventional dimple boards according to a sixth embodiment of the present invention. In FIG. 10A, a dimple 600A on a first dimple board 605A is aligned along an axis 608 with a dimple 600B on a second dimple board 605B. Dimple 605A has an end 610A opposite from a base 615A and dimple 605B has an end 610B opposite from a base 615B. Ends 610A and 610B are facing each other. Dimples 600A and 600B form an aligned dimple pair. A connector 620 is axially aligned between dimple 600A and dimple 600B. Connector 620 has the form of a hollow cylinder having an inner surface 625 and open at a first end 630A facing a top 610A of first dimple 600A and open at a second end 630B facing a top 610B of second dimple 600B.

Figure 10B:
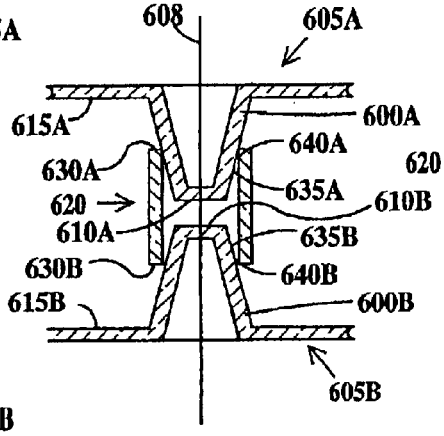
FIG. 10B is a partial cross-sectional view of two conventional dimple boards joined according to the sixth embodiment of the present invention.

FIG. 10B is a partial cross-sectional view of two conventional dimple boards joined according to the sixth embodiment of the present invention. In FIG. 10B a portion of an outside surface 635A of first dimple 600A is frictionally engaged with a first portion 640A of inside surface 625 of connector 620 and an outside surface 635B of second dimple 600B is frictionally engaged with a second portion 640B of inside surface 625 of connector 620. Thus, dimpled drain board 605A and dimpled drain board 605B are held in a spaced apart relationship.

While only one dimple per dimpled drain board is illustrated in FIGS. 10A and 10B, it is understood that each dimpled drain board contains a multiplicity of dimples. Further, while one connector is illustrated, there is a multiplicity of connectors. There may be a connector for each aligned dimple pair or a connector for less than every aligned dimple pair.

Figure 10C:
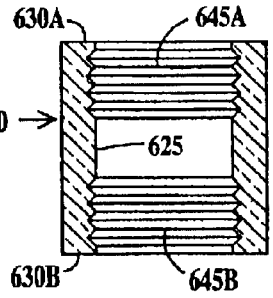
FIG. 10C is a cross-sectional view of connector according to the present invention.

FIG. 10C is a cross-sectional view of connector 620 according to the present invention. In FIG. 10C, an optional first set of grooves 645A is formed on inside surface 625 of connector 620 near first end 630A of the connector and an optional second set of grooves 645B is formed on inside surface 625 of connector 620 near second end 630B of the connector. Grooves 645A and 645B aid in gripping outside surfaces 635A of dimple 600A and outside surface 635B of dimple 600B respectively (see FIG. 10B).

Figure 11A:
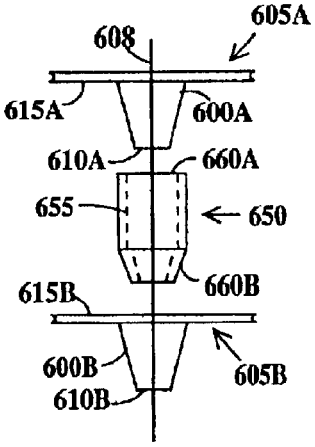
FIG. 11A is an exploded side view of a second connector for jointing two conventional dimple boards according to a seventh embodiment of the present invention.

FIG. 11A is an exploded side view of a first connector for jointing two conventional dimple boards according to a seventh embodiment of the present invention. In FIG. 11A, dimple 600A on first dimple board 605A is aligned along axis 608 with dimple 600B on second dimple board 605B. Ends 610A and 610B are facing in the same direction. A connector 650 is axially aligned between dimple 600A and dimple 600B. Connector 650 has the form of a hollow cylinder having an inner surface 655 and open at a first end 660A facing top 610A of first dimple 600A and open at a second end 660B facing a bottom 665B of second dimple 600B. (Second end 660B may be optionally closed). End 660B is tapered such in toward axis 608. Optionally, connector 650 may be solid except in the region of grooves 685A.

Figure 11B:
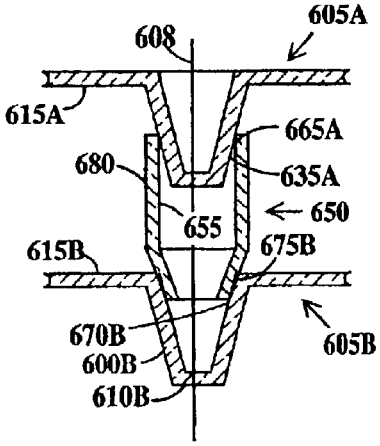
FIG. 11B is a partial cross-sectional view of two conventional dimple boards joined according to the seventh embodiment of the present invention.

FIG. 11B is a partial cross-sectional view of two conventional dimple boards joined according to the seventh embodiment of the present invention. In FIG. 11B a portion of outside surfaces 635A of first dimple 600A is frictionally engaged with a portion 665A of inside surface 655 of connector 625 and an inside surface 670B of second dimple 600B is frictionally engaged with a portion 675B of an outside surface 680 of connector 650. Thus, dimpled drain board 605A and dimpled drain board 605B are held in a spaced apart relationship.

While only one dimple per dimpled drain board is illustrated in FIGS. 11A and 11B, it is understood that each dimpled drain board contains a multiplicity of dimples. Further, while one connector is illustrated, there are a multiplicity of connectors. There may be a connector for each aligned dimple pair or a connector for less than every aligned dimple pair.

Figure 11C:
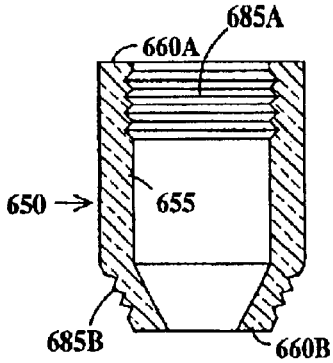
FIG. 11C is a cross-sectional view of a connector according to the present invention.

FIG. 11C is a cross-sectional view of connector 650 according to the present invention. In FIG. 11C, an optional first set of grooves 685A is formed on inside surface 655 of connector 650 near first end 660A of the connector and an optional second set of grooves 685B is formed on outside surface 680 of connector 650 near second end 660B of the connector. Grooves 685A and 685B aid in gripping outside surface 635A of dimple 600A and inside surface 670B of dimple 600B respectively (see FIG. 11B).

Figure 12:
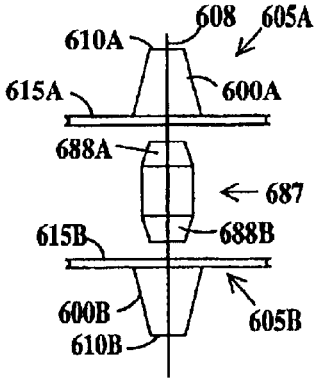
FIG. 12 is an exploded side view of a third connector for jointing two conventional dimple boards according to an eighth embodiment of the present invention.

FIG. 12 is an exploded side view of a third connector for jointing two conventional dimple boards according to an eighth embodiment of the present invention. In FIG. 12, dimple 600A on first dimple board 605A is aligned along axis 608 with dimple 600B on second dimple board 605B. Ends 610A and 610B are facing away from each other. Dimples 600A and 600B form an aligned dimple pair. A connector 687 is axially aligned between dimple 600A and dimple 600B. Connector 687 has the form of a cylinder having a first tapered end 688A facing dimple 600A and a second tapered end 688B facing dimple 600B. Tapered ends 688A and 688B are adapted to frictionally engage inside surfaces (not shown) of respective dimples 605A and 605B. Tapered ends 688A and 688B may include grooves as illustrated in FIG. 11C. Connecter 687 may be hollow or solid.

While only one dimple per dimpled drain board is illustrated in FIG. 12, it is understood that each dimpled drain board contains a multiplicity of dimples. Further, while one connector is illustrated, there are a multiplicity of connectors. There may be a connector for each aligned dimple pair or a connector for less than every aligned dimple pair.

Figure 13:
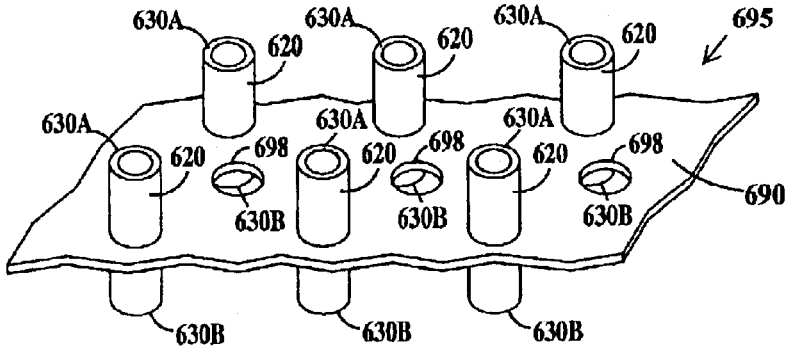
FIG. 13 is a partial perspective view of a connecting board according to the present invention.

FIG. 13 is a partial perspective view of connecting board 695 according to the present invention. While individual connectors 620, 650 and 687 may be employed to connect two dimpled drain boards in a spaced apart relationship, multiple connectors 620 (or 650 or 687) may be joined together. In FIG. 13, a multiplicity of connectors 620 (or 650 or 687) are joined together by a web 690 to form connecting board 695. Ends 630A of connectors 620 extend from one side of web 690 and ends 630B of connectors 620 extend from an opposite side of web 690. Web 695 may include a multiplicity of through holes 698 interspersed between connectors 620 (or 650). There may be a connector 620 (or 650) for each aligned dimple pair of perspective dimpled drain boards to be joined in a spaced apart relationship or a connector for less than every aligned dimple pair. The sixth and seventh embodiments of the present invention may be applied to pre-existing commercially available dimple drain boards.

Figure 14:
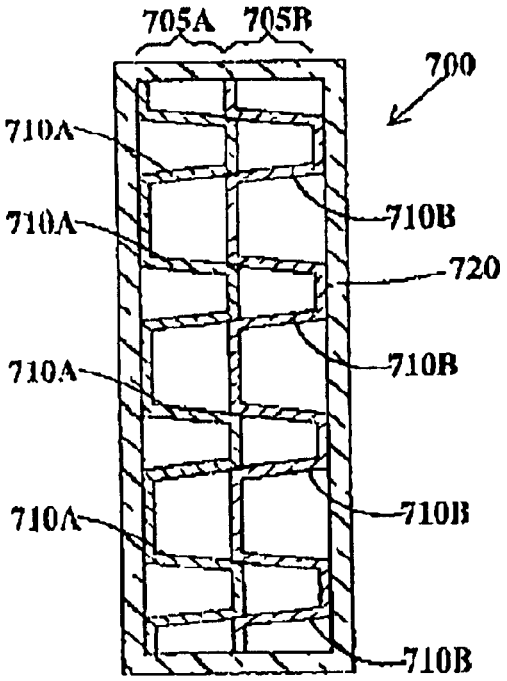
FIG. 14 is a cross-sectional view illustrating a high-flow drain formed from two dimpled drain boards according to the presenting invention.

FIG. 14 is a cross-sectional view illustrating a high-flow drain formed from two dimpled drain boards according to the presenting invention. In FIG. 14, a drain 700 includes a first dimpled drain board 705A and a second dimpled drain board 705B. A multiplicity of hollow dimples 710A are engaged with a multiplicity of corresponding hollow dimples 710B as illustrated in FIGS. 5B, 6B, 7B, 8B or 9B and described supra. Thus, first and second dimpled drain boards 705A and 705B are held in a spaced apart relationship. First and second drain boards are further wrapped in one of a sheet such as a filter fabric, a sheet protector, perforated board, finish board, and insulation board 720 to prevent soil from clogging the spaces between hollow dimples 710A and between hollow dimples 710B. Sheet 720 may be, for example, a water permeable sheet of needle punched impervious material such as polypropylene or a woven material or a fiber mat material.

Figure 15:
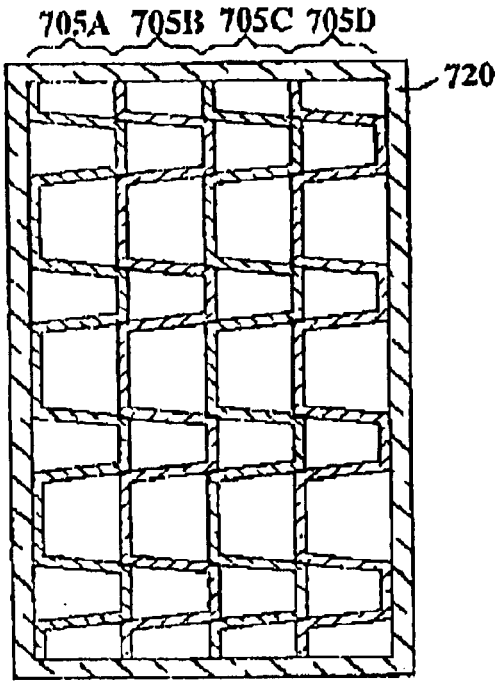
FIG. 15 is a cross-sectional view illustrating a drainpipe formed from four dimpled drain boards according to the presenting invention.

FIG. 15 is a cross-sectional view illustrating a drainpipe formed from four dimpled drain boards according to the presenting invention. FIG. 15, is similar to FIG. 14, but there are four dimpled drain boards 705A, 705B, 705C and 705D held in a spaced apart relationship and wrapped in sheet 720. FIG, 4 illustrates how the hollow dimpled drainage boards of the present invention may be used to form the equivalent of a perforated drainpipe. Any number of dimpled drain boards may be used and by increasing the number, water carrying capacity of the assembly is increased.

Figure 16:
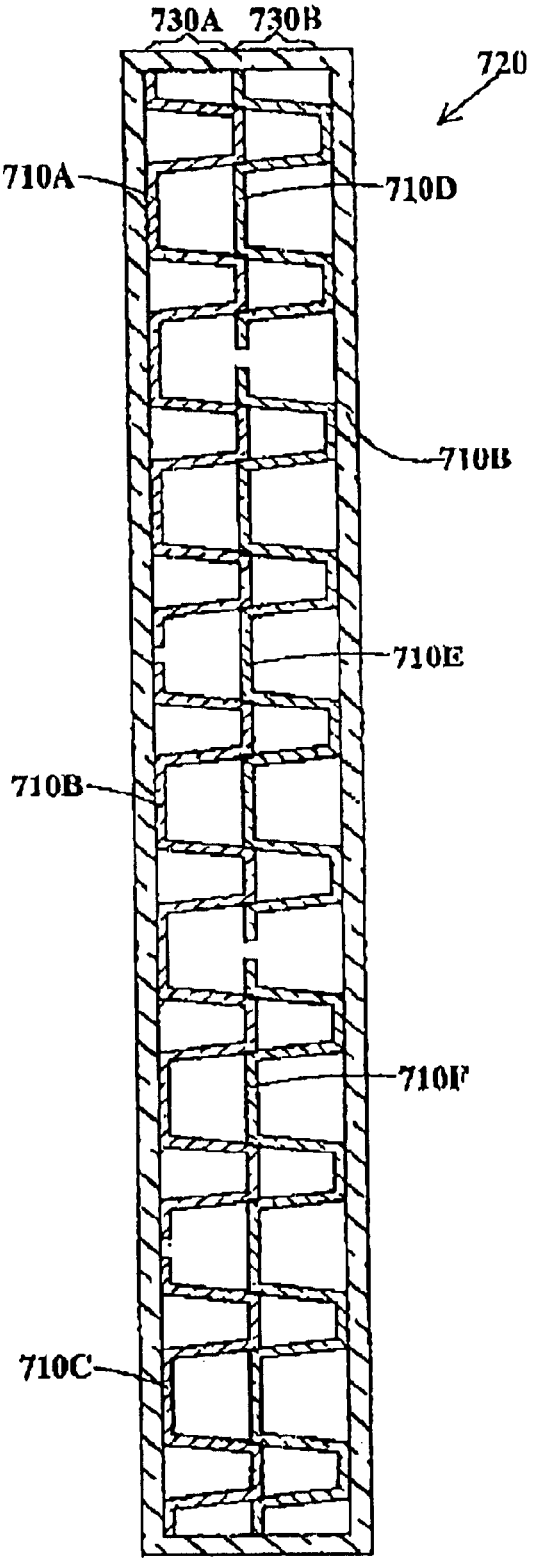
FIG. 16 is a cross-sectional view illustrating a high-flow drain formed from multiple dimpled drain boards according to the presenting invention.

FIG. 16 is a cross-sectional view illustrating a high-flow drain formed from multiple dimpled drain boards according to the presenting invention. In FIG. 16, drain 725 is formed from a first layer 730A of dimpled drain boards 735A, 735B and 735C and a second layer 730B of dimpled drain boards 735D, 735E and 735F. Dimpled drain board 730A overlaps and engages dimpled drain boards 730A and 730B thus holding dimpled drain board 730A in a fixed spatial relationship with dimpled drain board 730B. Dimpled drain board 730F overlaps and engages dimpled drain boards 730B and 730C thus holding dimpled drain board 730B in a fixed spatial relationship with dimpled drain board 730C. Thus, a drain formed according to the present invention may be extended in length and width with little chance of individual dimpled drain boards shifting position thus reducing the need for individually fastening each dimpled drain board to walls footing, etc., and most certainly reducing the need for fasteners or adhesives to join layers of dimpled drain boards together.

Figures 17, 17A:
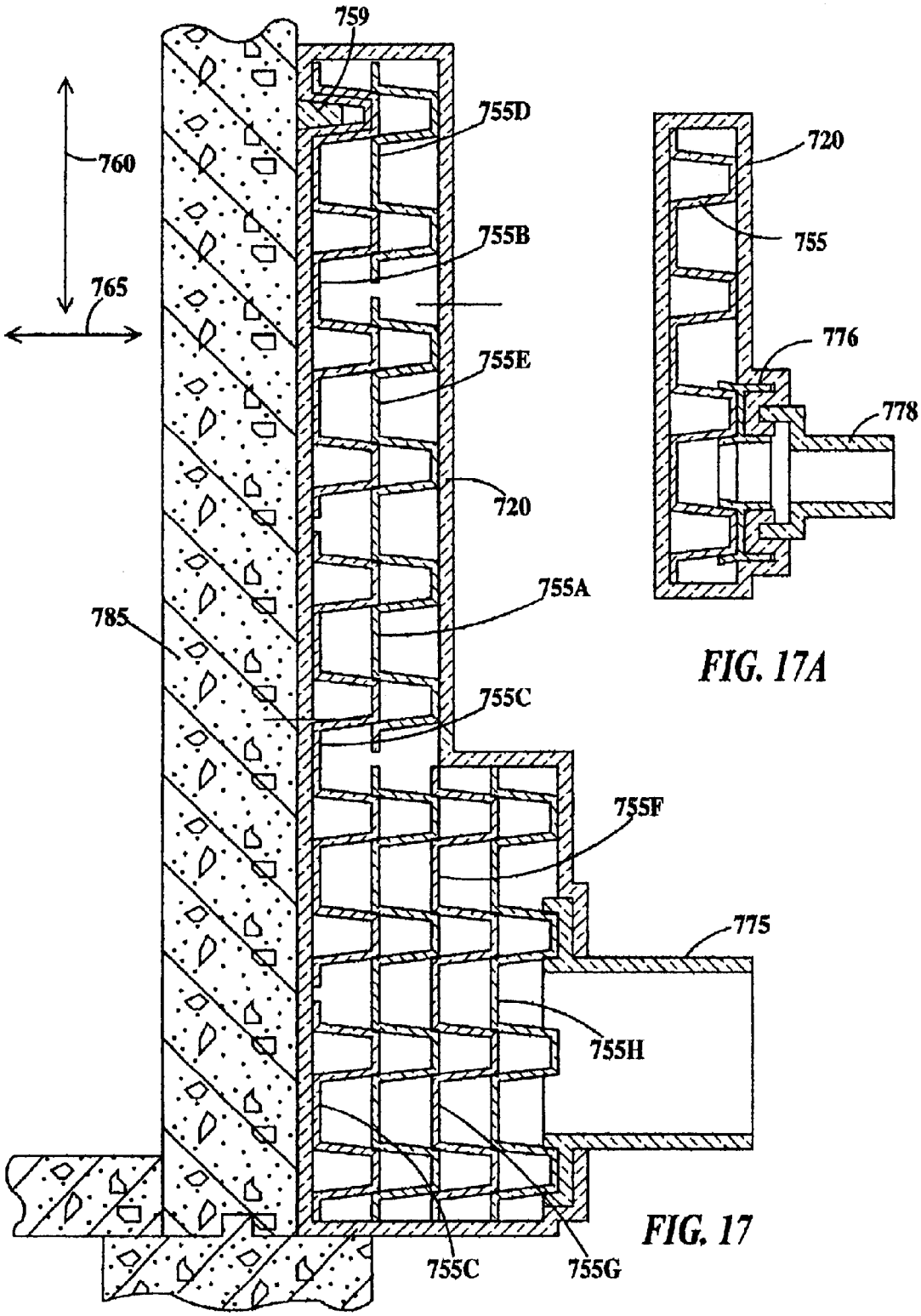
FIG. 17 is a cross-sectional view illustrating a high-flow drain system formed from multiple dimpled drain boards according to the presenting invention.
FIG. 17A is a cross-sectional view illustrating an alternative pipe connection according to the presenting invention.

FIG. 17 is a cross-sectional view illustrating a high-flow drain system formed from multiple dimpled drain boards according to the presenting invention. In FIG. 17, drain system 750 include dimpled drain boards 755A, 755B, 755C, 755E, 755D, 755E and 755F. Dimpled drain boards 755A, 755B and 755D are stacked in the vertical direction 760 as are dimpled drain boards 755D, 755E and 755F. Dimpled drain boards 755A, 755B and 755D are stacked over dimpled drain boards 755D, 755E in the horizontal direction 760. Dimpled drain board 755A overlaps and engages dimpled drain boards 755A and 755B thus holding dimpled drain board 755A in a fixed spatial relationship with dimpled drain board 755B. Dimpled drain board 755F overlaps and engages dimpled drain boards 755B and 755C thus holding dimpled drain board 755B in a fixed spatial relationship with dimpled drain board 755C. Dimpled drain board 755G is stacked horizontally over dimpled drain board 755E and dimpled drain board 755H is stacked horizontally over dimpled drain board 755H. A pipe connector 775 is fitted onto dimpled drain board 755H and attaches to a pipe or footing drain. Pipe connector 775 adapted to engage hollow dimples 770 on dimpled drain board 755H. Dimpled drain boards 755A, 755B, 755C, 755E, 755D, 755E and 755F are covered with sheet 720. In use drain system 750 is installed against a wall 785 below grade. Note pipe connector 775 may be attached to a single dimpled drain board as well. Optionally, one or more connectors 759 may be part of sheet 720 or may be attached directly to a wall 785 for holding sheet 720 in place.

FIG. 17A is a cross-sectional view illustrating an alternative pipe connection according to the presenting invention. In FIG. 17A, a retaining ring 776 is placed in contact with a dimpled drain board 755. The retaining ring 776 should not be limited to a ring, but may be any connector of various geometries such as a snap fit using any of the aforementioned attachments or may be a hook and loop fastener or a friction fit as illustrated. In particular, any of numerous types of connectors may be envisioned that assists in holding one of more of a pipe, a footing drain, a filter fabric, a sheet protector, perforated board, finish board, and insulation board to a dimple on a dimple board. Sheet 720 is placed around dimpled drain board 755 and over retaining ring 776. A pipe connector 778 adapted to be press fitted into retaining ring 776 in order to hold sheet 720 in place. Retaining ring 776 and pipe connector 778 may be used with conventional dimpled drain boards as well as dimpled drain boards according to the present invention.

Figure 18:
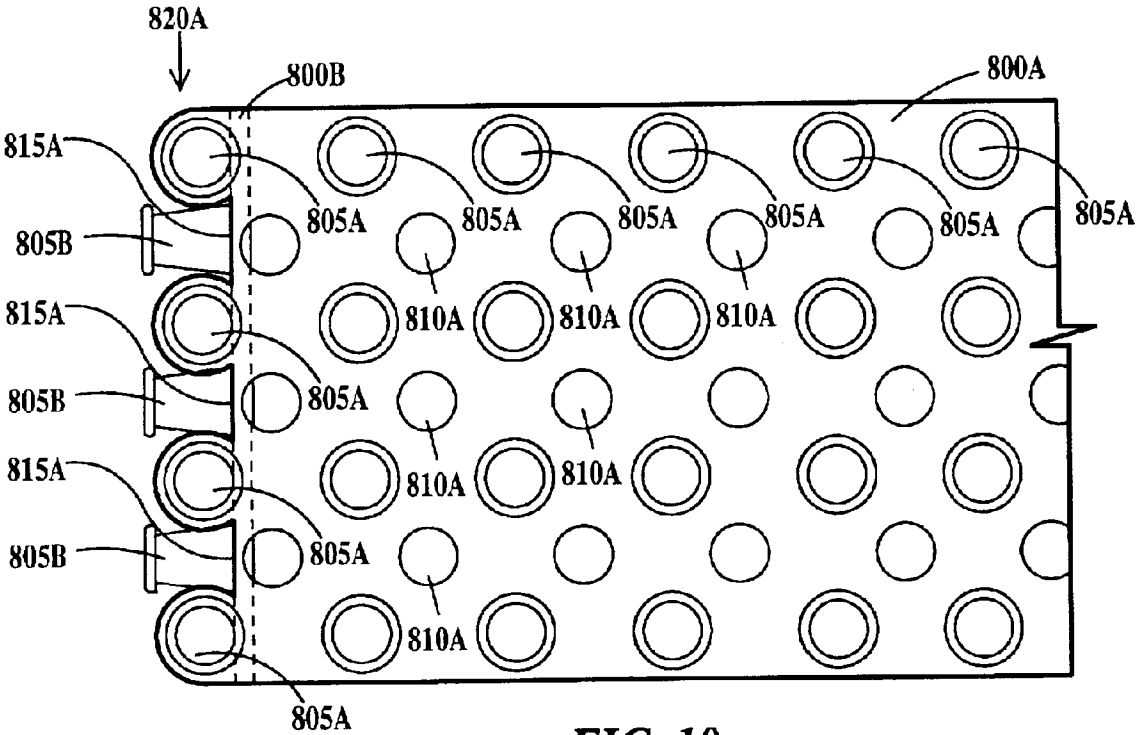
FIG. 18 is a partial front view of two dimpled drain boards engaged perpendicular to one another according to the presenting invention.
Figure 19:
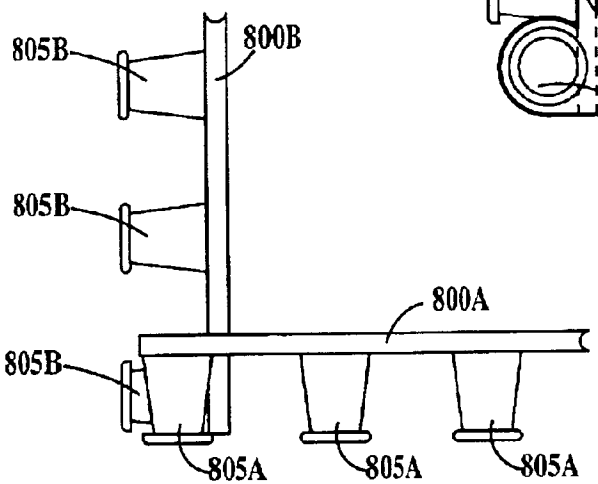
FIG. 19 is a partial top view of the dimpled drain boards of FIG. 18.

FIG. 18 is a partial front view of two dimpled drain boards engaged perpendicular to one another according to the present invention and FIG. 19 is a partial top view of the dimpled drain boards of FIG. 18. In FIG. 19 a first dimpled drain board 800A includes a multiplicity of hollow dimples 805A and a multiplicity of optional drain holes 810A. A series of notches 815A are cut between an edge-row of hollow dimples 805A into an edge 820A of dimpled drain board 800A. Each notch 815A is adapted to engage with a corresponding edge-row of hollow dimples 805B from a second dimpled drain board 800B positioned perpendicularly to first dimpled drain board 800A.

Thus, the present invention provides a drainage system that is field adjustable in terms of the quantity of water it can handle and that minimizes the need for fasteners.

The description of the embodiments of the present invention is given above for the understanding of the present invention. It will be understood that the invention is not limited to the particular embodiments described herein, but is capable of various modifications, rearrangements and substitutions as will now become apparent to those skilled in the art without departing from the scope of the invention. Therefore, it is intended that the following claims cover all such modifications and changes as fall within the true spirit and scope of the invention.

What is claimed is:

1. A dimpled drain board comprising:

a planar base;

a hollow dimple extending perpendicularly from said planar base; and a connector, said connector adapted to maintain said planar base in a spaced apart relationship from another planar base of another dimpled drain board having another hollow dimple, further wherein said connector is a projecting lip extending perpendicularly from an outside surface of said hollow dimple;

further including a recess formed on an inside surface of said hollow dimple, said recess adapted to snap fit with another projecting lip of said another hollow dimple of said another dimpled drain board.

2. A dimpled drain board comprising:

a planar base;

a hollow dimple extending perpendicularly from said planar base; and a connector, said connector adapted to maintain said planar base in a spaced apart relationship from another planar base of another dimpled drain board having another hollow dimple, further wherein said connector is a projecting lip extending perpendicularly from a top of said hollow dimple;

further including a recess formed on an inside surface of hollow dimple, said recess adapted to snap fit with a another projecting lip of said another hollow dimple of said another dimpled drain board.

3. A dimpled drain board comprising:

a planar base having a first surface and a second surface;

a multiplicity of hollow dimples arranged in a repeating pattern and extending perpendicularly from said planar base, each hollow dimple having a sidewall, a top and a bottom open to said second surface; and a connector operatively associated with all or less than all said hollow dimples, each connector adapted to maintain said planar base and another planar base of another dimpled drain board in a spaced apart relationship, further wherein each connector is a projecting lip extending perpendicularly from an outside surface of each sidewall of each hollow dimple;

further including recesses formed on inside surfaces of each sidewall of each hollow dimple, said recesses adapted to snap fit with other projecting lips of other hollow dimples of said another dimpled drain board.

4. A dimpled drain board comprising:

a planar base having first surface and a second surface;

a multiplicity of hollow dimples arranged in a repeating pattern and extending perpendicularly from said planar base, each hollow dimple having a sidewall, a top and a bottom open to said second surface;

a connector operatively associated with all or less than all said hollow dimples, each connector adapted to maintain said planar base and another planar base of another dimpled drain board in a spaced apart relationship, further wherein each connector is a projecting lip extending perpendicularly from each top of each hollow dimple; and recesses formed on inside surfaces of each sidewall of each hollow dimple, said recesses adapted to snap fit with other projecting lips of other hollow dimples of said another dimpled drain board.

5. A dimpled drain board comprising:

a planar base having a first surface and a second surface;

a multiplicity of hollow dimples arranged in a repeating pattern and extending perpendicularly from said planar base, each hollow dimple having a sidewall, a top and a bottom open to said second surface;

a connector operatively associated with all or less than all said hollow dimples, each connector adapted to maintain said planar base and another planar base of another dimples drain board in a spaced apart relationship, wherein each connector is a cylinder having a first end and a second end, said first end adapted to operatively engage an outer surface of said hollow dimple and said second end adapted to operatively engage an outer surface of said another hollow dimple; and a planar web holding said connectors together in a spaced apart relationship.

6. A dimpled drain board comprising:

a planar base having first surface and a second surface;

a multiplicity of hollow dimples arranged in a repeating pattern and extending perpendicularly from said planar base, each hollow dimple having a sidewall, a top and a bottom open to said second surface;

a connector operatively associated with all of less than said hollow dimples, each connector adapted to maintain said planar base and another planar base of another dimpled drain board in a spaced apart relationship, wherein each connector is a cylinder having a first end and a second end, said first end adapted to operatively engage one of an outer surface and an inner surface of said hollow dimple and said second end adapted to operatively engage one of an inner surface and on outer surface of said hollow dimple; and a planar web holding said connectors together in a spaced apart relationship.

7. A drainage system comprising:

at least two dimpled drain boards, each dimpled drain board comprising:

a planar base having a first surface and second surface;

a multiplicity of hollow dimples arranged in a repeating pattern and extending perpendicularly from said first surface of said base, each hollow dimple having a sidewall, a top and a bottom open to said second surface;

a connector on all or less than all said hollow dimples, each connector adapted to maintain said planar base of said dimpled drain board and another planar base of another dimpled drain board in a spaced apart relationship, said another dimpled drain board having other hollow dimples identical to said hollow dimples of said dimpled drain board, further wherein each connector is a projecting lip extending perpendicularly from an outside surface of each sidewall of each hollow dimple;

filter means arranged to prevent non-fluid materials from depositing between said hollow dimples; and recesses formed on inside surfaces of each sidewall of each hollow dimple, said recesses adapted to snap fit with other projecting lips of said other hollow dimples of said another dimpled drain board.

8. A drainage system comprising:

at least two dimpled drain boards, each dimpled drain board comprising:

a planar base having a first surface and second surface;

a multiplicity of hollow dimples arranged in a repeating pattern and extending perpendicularly from said first surface of said base, each hollow dimple having a sidewall, a top and a bottom open to said second surface; and a connector on all or less than all said hollow dimples, each connector adapted to maintain said planar base of said dimpled drain board and another planar base of another dimpled drain board in a spaced apart relationship, said another dimpled drain board having other hollow dimples identical to said hollow dimples of said dimpled drain board, further wherein each connector is a projecting lip extending perpendicularly from each top of each hollow dimple;

filter means arranged to prevent non-fluid materials from depositing between said hollow dimples; and recesses formed on inside surfaces of each sidewall of each hollow dimple, said recesses adapted to snap fit with other projecting lips of said other hollow dimples of said another dimpled drain board.

9. A drainage system comprising:

at least two dimpled drain boards, each dimpled drain board comprising:

a planar base having a first surface and second surface;

a multiplicity of hollow dimples arranged in a repeating pattern and extending perpendicularly from said first surface of said base, each hollow dimple having a sidewall, a top and a bottom open to said second surface; and a connector on all or less than all said hollow dimples, each connector adapted to maintain said planar base of said dimpled drain board and another planar base of another dimpled drain board in a spaced apart relationship, said another dimpled drain board having other hollow dimples identical to said hollow dimples of said dimpled drain board, further wherein each connector is a cylinder having a first end and a second end, said first end adapted to operatively engage one of an outer surface and an inner surface of said hollow dimple and said second end adapted to operatively engage one of an outer surface and an inner surface of said another hollow dimple;

a filter means arranged to prevent non-fluid materials from depositing between said hollow dimples; and further including a planar web holding said connectors together in a spaced apart relationship.

10. A drainage system comprising:

at least two dimpled drain boards, each dimpled drain board comprising:

a planar base having a first surface and second surface;

a multiplicity of hollow dimples arranged in a repeating pattern and extending perpendicularly from said first surface of said base, each hollow dimple having a sidewall, a top and a bottom open to said second surface; and a connector on all or less than all said hollow dimples, each connector adapted to maintain said planar base of said dimpled drain board and another planar base of another dimpled drain board in a spaced apart relationship, said another dimpled drain board having other hollow dimples identical to said hollow dimples of said dimpled drain board, further wherein each connector is a cylinder having a first end and a tapered second end, said first end adapted to operatively engage an outer surface of said hollow dimple and said tapered second end adapted to operatively engage an inner surface of said another hollow dimple; and filter means arranged to prevent non-fluid materials from depositing between said hollow dimples.

11. The drainage system of claim 10 further including a planar web holding said connectors together in a spaced apart relationship.

* * * * *